United States Patent [19]

Fowler

[11] 4,357,821

[45] Nov. 9, 1982

[54] GAUGE AND WORKPIECE HOLDER FOR A FORMING MACHINE

[76] Inventor: Joseph M. Fowler, 334 Westover Rd., Stamford, Conn. 06902

[21] Appl. No.: 176,903

[22] Filed: Aug. 11, 1980

[51] Int. Cl.[3] ..... B21D 11/22

[52] U.S. Cl. ..... 72/389; 72/461; 83/522

[58] Field of Search ..... 72/389, 386, 461, 36, 72/34, 35, 32, 33; 83/522, 360, 364; 270/58; 100/99; 269/8

[56] References Cited

U.S. PATENT DOCUMENTS 2,429,387 10/1947 Buchheim ..... 72/461
3,704,611 12/1972 Hirsch ..... 72/36
3,812,695 5/1974 Roch ..... 72/461
3,826,119 7/1974 Marotto ..... 72/461
4,055,070 10/1977 Wingate .

FOREIGN PATENT DOCUMENTS 508314 3/1976 U.S.S.R. ..... 72/461

*Primary Examiner*—Gene Crosby
*Attorney, Agent, or Firm*—Alfred E. Miller

[57] ABSTRACT

In a magnetic workpiece holder and gauge for a press brake, the core of an electromagnet for the work core is electrically insulated, and connected to a circuit for energizing the electromagnet when electrical contact is made between a magnetic workpiece and the core structure of the electromagnet. A probe may also be provided for detecting the lateral alignment of the workpiece.

11 Claims, 13 Drawing Figures

Fig. 1.
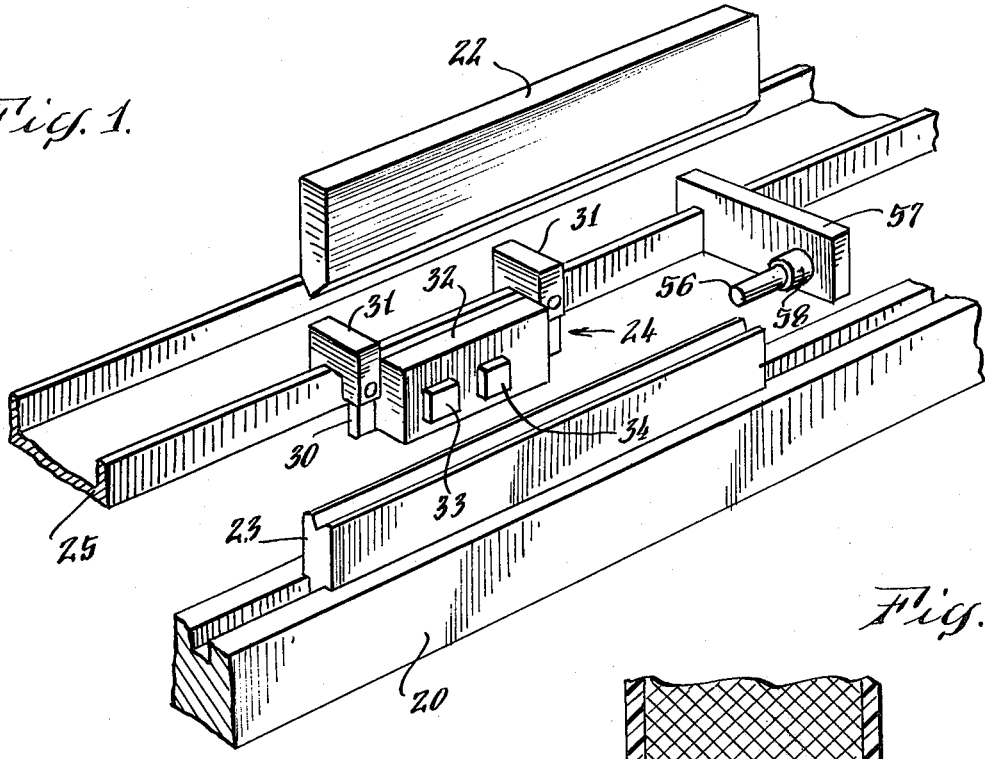
Fig. 4.
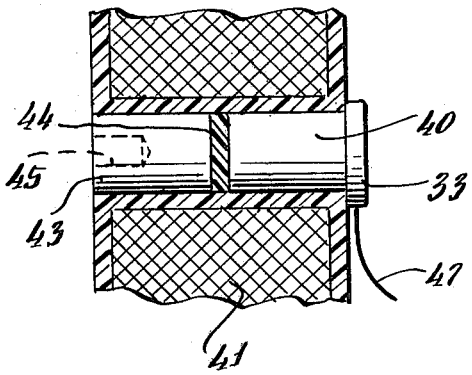
Fig. 2.
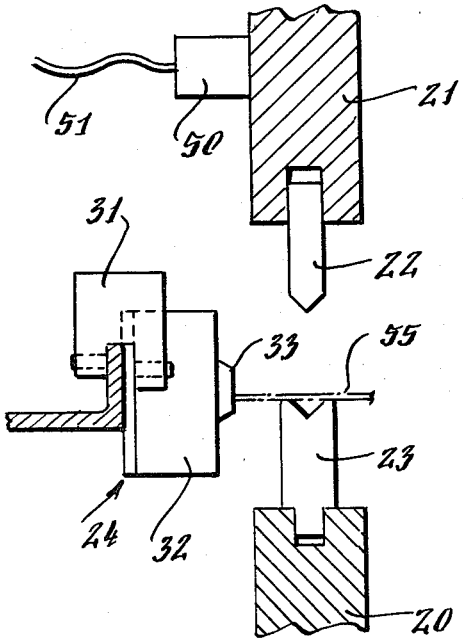
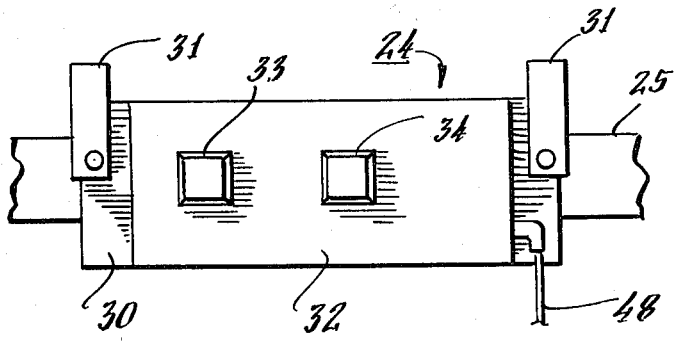
Fig. 3.

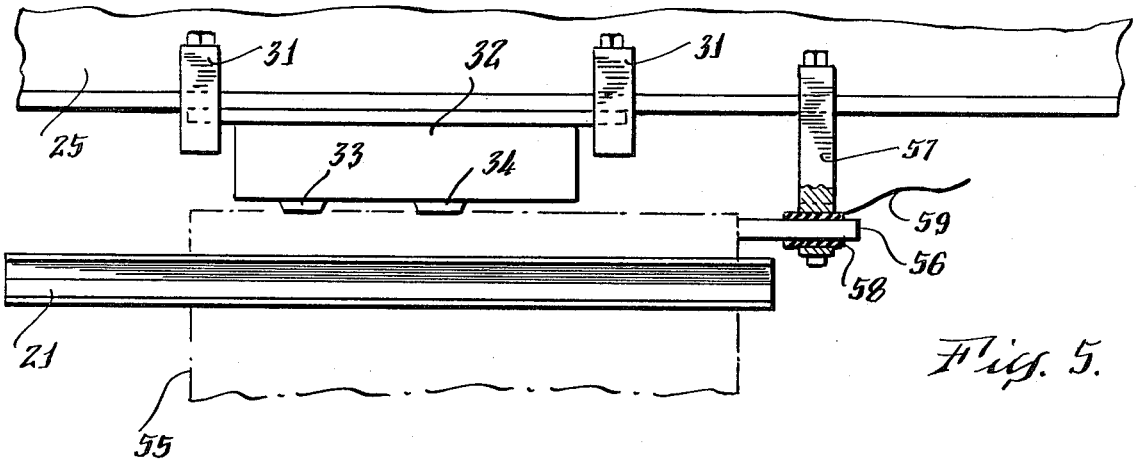
Fig. 5.
Fig. 11.
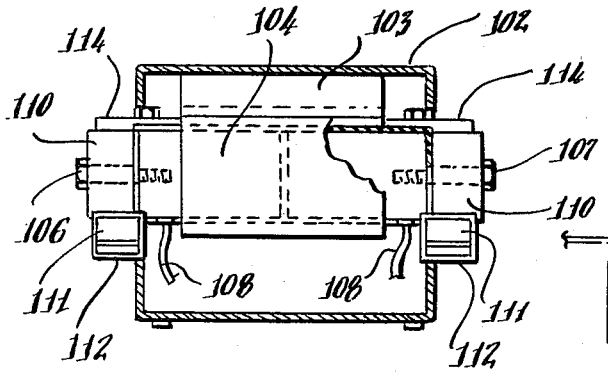
Fig. 12.
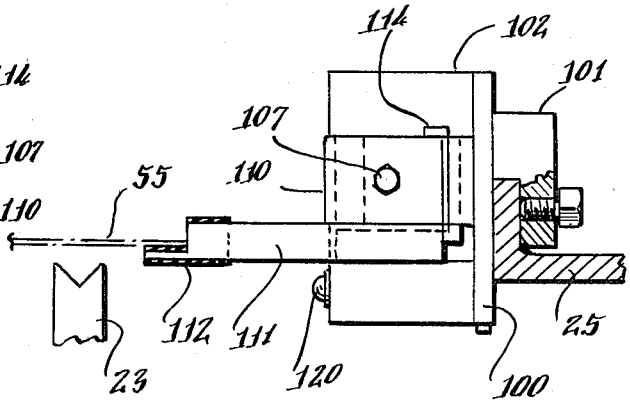
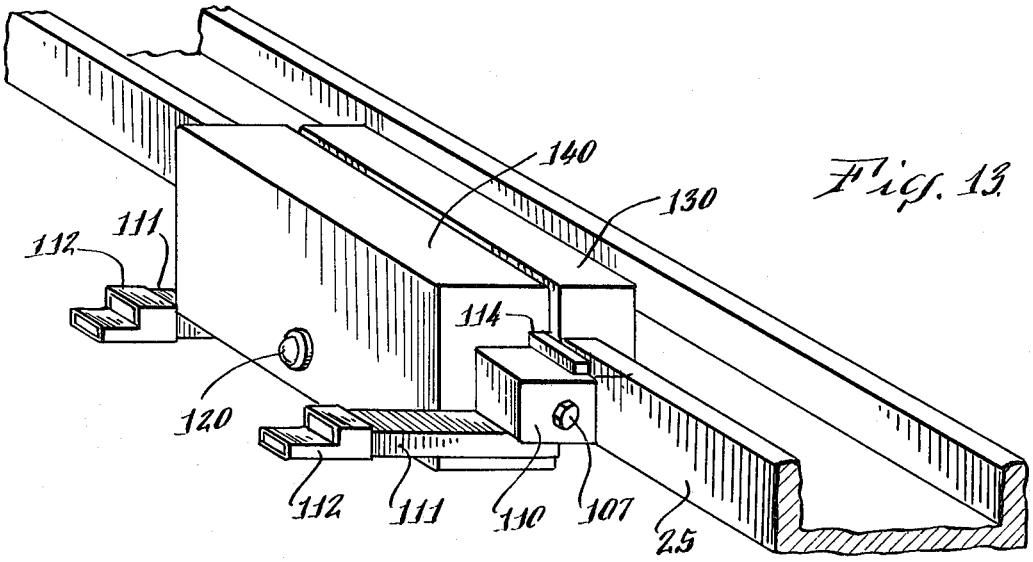
Fig. 13.

GAUGE AND WORKPIECE HOLDER FOR A FORMING MACHINE

This invention relates to a combined gauging device and workpiece holder for a forming device, especially for a press brake or the like. It will of course be apparent that the gauge and workpiece holder of the invention is adapted to other types of forming tools, wherein a workpiece, such as sheet metal must be held at least until a forming operation has commenced.

Press brakes of one kind are comprised of an elongated generally stationary lower die, and a vertically movable upper die, which can be lowered to the lower die by means of a ram. In forming of sheet metal or the like, the metal is placed between the dies, and the ram is lowered. In such equipment, it is undesirable to require an operator to hold the workpiece, especially for safety reasons.

For this reason, a gauge and workpiece holder has been developed and employed, wherein an electromagnet is mounted behind the dies, so that an operator need only insert the sheet metal between the dies until it engages the electromagnet. The electromagnet will thus hold the sheet metal at this position, the electromagnet being positioned at the correct place in order to bend the sheet metal. Of course adequate control means must be provided, so that the sheet metal is released by the electromagnetnet as soon as the upper die contacts the sheet metal, in order that no interference arise between the sheet metal and the gauge. In addition, the electromagnet must be controlled to once again be energized after the upper die has been moved to its upper position.

In order that the invention will be more clearly understood, it will now be disclosed in greater detail, with reference to the accompanying drawings, wherein:

FIG. 1 is a perspective view of a portion of a press brake embodying the gauge and workpiece holder of one embodiment of the invention;

FIG. 2 is a cross-sectional view of the apparatus of claim 1;

FIG. 3 is a front view of the gauge and workpiece holder of the apparatus of FIG. 1;

FIG. 4 is a cross-sectional view of a portion of the gauge and workpiece holder of FIG. 1;

FIG. 5 is a simplified top view of a modification of the structure of FIG. 1, showing a side detecting device;

FIG. 11 is a partially cross-sectional front view of a gauge and workpiece holder in accordance with a still further embodiment of the invention;

FIG. 12 is a partially cross-sectional view of the apparatus of claim 11; and FIG. 13 is a perspective view of a modification of the gauge and workpiece holder of FIG. 12.

Figure 6:
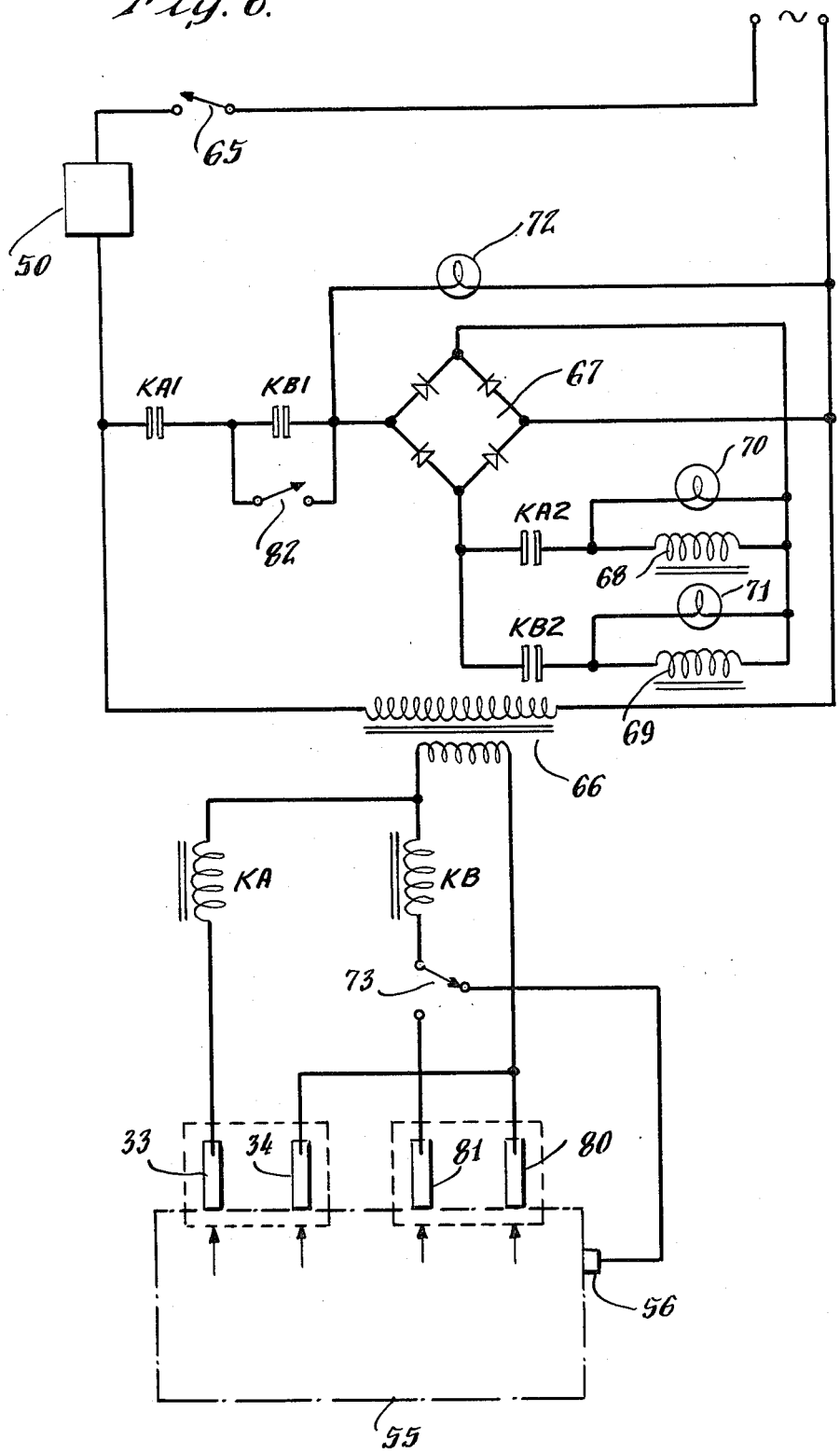
FIG. 6 is a circuit diagram for use with the apparatus in accordance with the invention.

Referring now to the drawings, and more in particular to FIGS. 1–4, therein is illustrated one embodiment of a gauge and magnetic work holder, in accordance with the invention. In this embodiment, the gauge is employed on a press brake having a bed 20, a ram 21, an upper die 22 and a lower die 23. The gauge and work holder 24 is mounted on a tool mounting rail 25, behind and spaced from the dies. The gauge and work holder 24 may be comprised of a back plate 30 clamped, by means of clamps 31, at each end thereof, to the tool mounting rail 25. The guide and work holder further comprises a forwardly extending casing 32, from which a pair of magnetic pole faces 33 and 34 extend toward the dies 22 and 23. It will of course be apparent that the portions of the press brake illustrated in the figures is for the purpose of explanation only, and other conventional configurations of the brake may be employed.

In the example of the invention illustrated in FIG. 4, the pole face 33 is connected to a first partial core 40, which extends only part way into the electromagnet 41. The front portion 40 of the core is separated from the rear portion 43 by an electrically insulating layer 44. Conventional insulation may also be provided between the coil 41 and the core, as illustrated. A capsule 45 is shown, to enable mounting of the core on the back plate 30. In addition, as illustrated in FIG. 4, a conductor 47 is shown attached to the pole face 33. This showing of the conductor is for illustrative purposes only, and, in a practical embodiment, the electrical connection will preferably be within the casing 32. The other core, to which the pole face 34 is affixed, is constructed in a similar manner.

As an alternative, the core of the electromagnet, serving as a probe-electromagnet, may extend completely through the electromagnet. In this alternative, an insulating layer may be applied against the inside surface of the back plate, to electrically insulate the core. The core may be bolted to the back plate, employing conventional insulation to insulate the core from the back plate. In this manner, the core assembly has fewer parts, and the probe portion of the core is not physically floating, as in the arrangement of FIG. 4. The bolt or other fastener of the core may further be employed as an electric terminal for connecting the electric circuit to the probe.

FIG. 3 illustrates a cable 48 extending from the casing, this casing including, for example, the excitation conductors for the electromagnets, as well as the contact conductors 47 connected to the two pole faces.

In the above structure, as will be explained in greater detail in the following paragraphs, it is necessary for the pole face to be electrically insulated from the remainder of the structure, and this may be effective by any other conventional means. The split core arrangement disclosed enables the rear portion of the core to be affixed to the back plate, whereby the back plate may serve as a part of the magnetic return path for the two poles. The arrangement of two poles adjacent one another provides the advantage that long shunt paths are not necessary in the workpiece, if a magnetic workpiece is employed.

In conventional magnetic work holders, for example, for press brakes, a control unit, illustrated by the reference numeral 50 in FIG. 2, is responsive to the position of the ram, so that the electromagnets are energized at the top of a stroke, and are deenergized at the time the die of the ram engages the material to be bent. If desired, a time delay may be provided for energizing the electromagnets at the top of the stroke, in order to simplify the removal of a magnetic workpiece after the ram has moved upwardly. FIG. 2 thus shows control wires 51 for controlling the electromagnets.

As illustrated in FIG. 2, the pole faces of the gauge 24 are positioned to the rear of the top of the lower die 23, so that a workpiece 55 may be laid on the top of the lower die to extend to engage the pole faces 33 and 34. In FIG. 2 the ram is in its upward position, and hence the electromagnets will be energized. The magnetic force of these electromagnets thus acts on the metal, to draw the metal into contact therewith. It is evident that the gauge 24 may thus be positioned to hold the workpiece at any desired location, for example, for bending, and that the magnetic action of the gauge firmly holds the metal until it is clamped between the dies. The deenergizing of the electromagnets is of course necessary, so that the holding action of the magnets will not interfere with the desired bending of the metal. It is of course apparent that, with a magnetic holding arrangement, the operator's hands may be removed from the area of the dies, to prevent injury.

The metal workpiece, when it is correctly positioned, contacts both of the pole faces, and hence forms a conductive bridge therebetween. This is employed, in accordance with the invention, to insure the proper operation of the device. It is for this reason that the pole faces must be electrically insulated.

In a further feature, in accordance with the invention, a further contact 56 is mounted to the tool mounting rail 25, by means of a clamp 57. The contact 56 is insulated from the clamp 57 by suitable insulation 58, and a lead 59 is provided extending from this contact. The contact 56 is adjustably positioned to be able to engage the side of a workpiece 55, when the leading edge of the workpiece engages the pole pieces 33 and 34. Thereby, means are provided for properly aligning the side of the workpiece.

The operation of the system in accordance with the invention will now be discussed in greater detail with reference to FIG. 6, which is a simplified circuit diagram of a system in accordance with the invention. The system is adapted to be energized from a source of power by means of a switch 65, and the controller 50. Upon energization, the line voltage is applied to the primary winding of a step down transformer 66. The secondary winding of the transformer 66 is applied to the relay winding KA by way of the pole face contacts 33 and 34, so that when the workpiece 55 contacts both of these contact pole faces, the relay coil KA is energized. In addition, the relay coil KB is energized by the secondary winding of the transformer 66 by way of the contact 80 and the contact 56. Consequently, when the workpiece 55 is properly aligned in the sidewise direction and against the contact 34, the relay coil KB is energized. The energization of the relay coils KA and KB results in the closing of their respective contact KA1 and KB1. This applies the AC power to a rectifier bridge 67, to provide DC power for the electromagnets. Thus, the electromagnet coil 68 with which the pole faces 33 and 34 are associated, is energized by way of the other contacts KA2 of the relay coil KA. In addition, the coil 69 of the electromagnet with which the pole face 80 is associated is energized by the contacts KB2 of the relay coil KB. Thus, since the electromagnets are thus energized, the workpiece 55, if it is a magnetic material, is drawn against the pole faces. At this time, since the indicator lamps 70 and 71 are in parallel with the electromagnet windings 68 and 69 respectively, these indicating lamps are lit, so that an operator will know that the workpiece is properly aligned and that the magnetic circuit has been energized, to hold the workpiece in position prior to the forming operation.

A further lamp 72 is mounted on the outside of the controller 50, so that the operator will be aware that the workpiece has made true contact with the gauge.

In the arrangement illustrated in FIG. 6, the relay coil KB is shown connected to the contact 56 by way of the switch 73. If it is not necessary to align the edge or side of the workpiece, the switch 73 may be switched to connect the relay coil KB alternatively to a further contact 81 in the magnet structure of the contact 80. In this arrangement, the electromagnet associated with the contacts 80 and 81 is energized when the workpiece engages the contact pole faces 80 and 81. Thus, it is apparent that several magnet structures may be provided along the front edge of the workpiece.

As a further variation, a switch 82 may be connected in shunt with the relay contacts KB1. This enables energization of the coil 68, upon the initial alignment of the workpiece to engage the contacts 33 and 34, so that it is not necessary for all of the contacts to be established before a workpiece holding action occurs.

Figure 7:
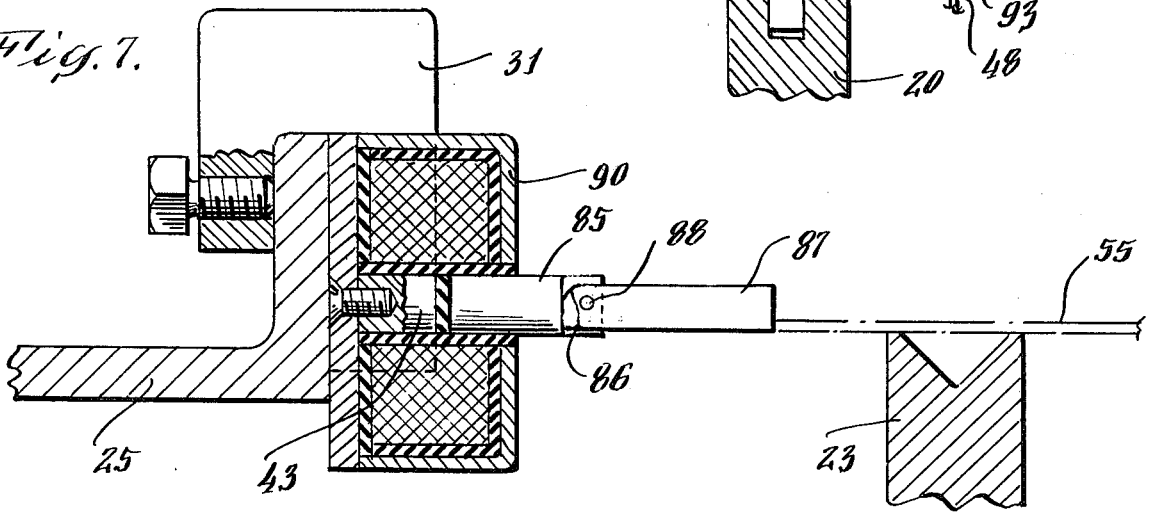
FIG. 7 is a partially cross-sectional view of a further modification of the system of FIG. 1.
Figure 8:
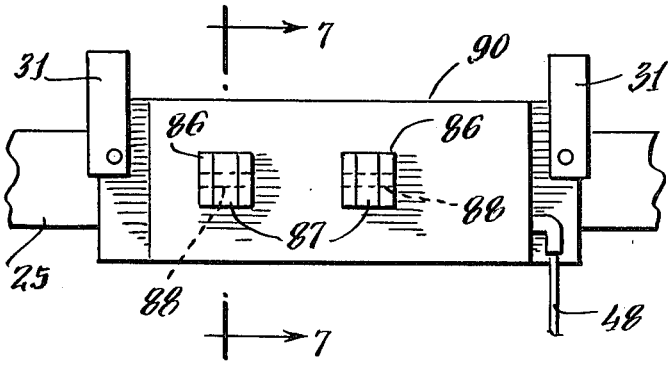
FIG. 8 is a front view of the modified apparatus of FIG. 7.

In a further embodiment of the invention, as illustrated in FIGS. 7 and 8, the front pole piece is replaced by a front core portion 85 having a vertically extending ridge 86, to which fingers 87 are pivoted by means of a pin 88. The pins 88 are at the upper portion of the rear edge of the fingers 87, so that the pins are urged by gravity to extend horizontally, with their rear edges engaging the flat front face of the core portion 85. With this arrangement, if it is necessary to make several bends in the front edge of a workpiece, the pivoting bent portion of the workpiece which may be under the fingers 87 before bending, will be able to push the fingers upwardly out of the way, as shown in the dashed lines in FIG. 7, to prevent interference.

Figure 9:
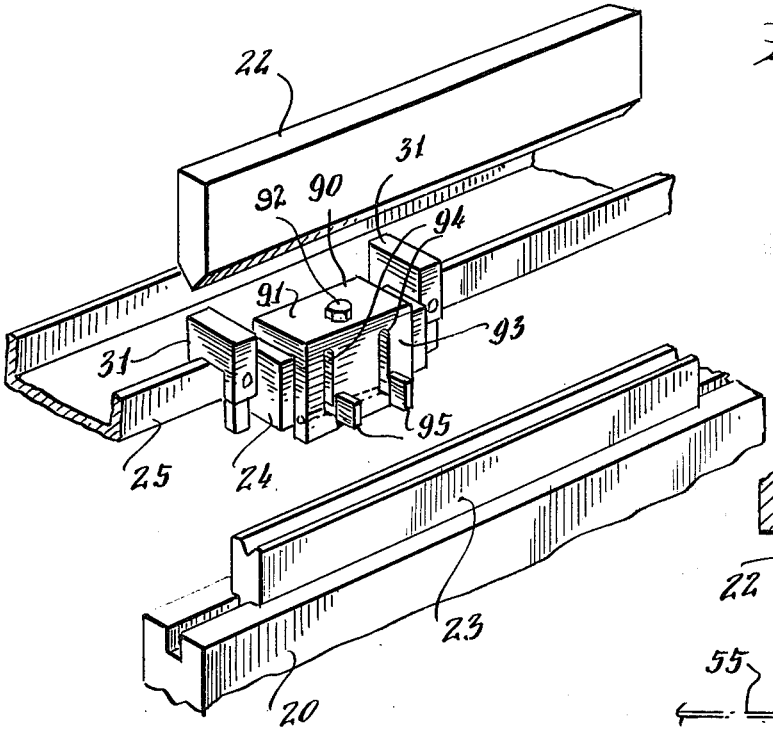
FIG. 9 is a perspective view of a portion of a press brake incorporating a further embodiment of the gauge and workpiece holder of the invention.
Figure 10:
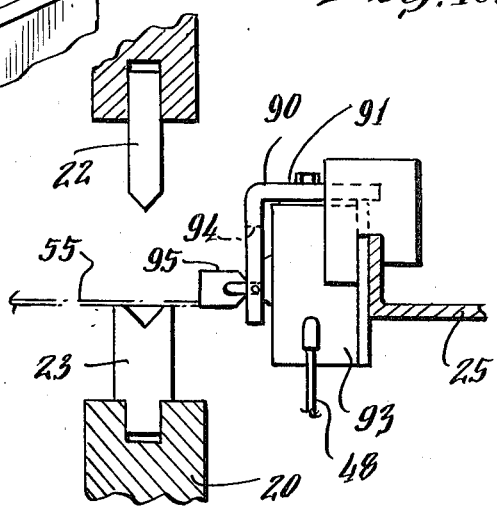
FIG. 10 is a cross-sectional view of the machine of FIG. 9.

The arrangement of FIGS. 7 and 8 may be somewhat difficult to adjust, and, for this purpose, the embodiment of the invention illustrated in FIGS. 9 and 10 enables multiple use of the device. Thus, in this arrangement the gauge and workpiece holder is essentially that as illustrated in FIGS. 1–4. An adaptor 90 comprises an angle-shaped base with one portion 91 fitted over the top of the gauge element 24 and bolted thereto by bolt 92. The front portion 93 of the angle-shaped element extends downwardly in front of the pole faces, and has a vertically extending slot 94 aligned with each pole face. Within the slots, lever elements 95 are pivoted, the lever elements being adapted to rest on the bottom of the slots, so that, under the force of gravity, they normally extend horizontally. When interference results with a workpiece during bending, the workpiece may pivot the levers 95 upwardly. It is of course apparent that the rear portions at the bottom of the slots must be relieved, in order to permit such pivoting.

A still further embodiment of the invention is illustrated in FIGS. 11 and 12. In this arrangement, the back plate 100 is affixed to a rearwardly extending clamp 101, to be fit over and bolted on the tool mounting rail 25. Within the housing 102, an electromagnet 103 having a horizontal axis parallel to the rail 25, is provided with end core portions 104 and 105 insulated from one another at the center of the coil. The solenoid may be bolted to the back plate by any convenient means. The core portions 104 and 105 are rigidly held within the coil, and pivot bolts 106 and 107 extend axially outwardly from the centers of these cores, outside of the housing 102. Electrical conductors 108 are connected to the core portions, for control in accordance with the above disclosure.

Blocks 110 are pivotally mounted to each of the hinge bolts 106 and 107, and arms 111 extend forwardly from the lower edge of each block 110. The forward ends of the arms 111 may be stepped, to enable the provision of two vertical gauging portions on each arm. Insulation 112 is provided on the front end of each of the arms, with the exception of the vertical gauging surfaces. This prevents electrical contact between the arms and the workpiece except at the gauging surfaces. The arms 111 can pivot downwardly under the force of gravity to a horizontal position, at which position the upper rear corners of the blocks 110 engage stops 114. As in the previously discussed arrangement, the pivotal action of the arrangement of FIGS. 11 and 12 enables the contact arms to be moved out of position by the workpiece to avoid interference.

In the arrangement of FIGS. 11 and 12, it will be noted that an indicator light 120 is provided on the front of the housing 102. It is of course apparent that the other indicator lights 70 and 71 of FIG. 6 may be employed in the embodiment of FIGS. 11 and 12, and that these lamps may also be suitably located in the other arrangements of the invention.

The stepped ends of the arms 111 enable the bending of small edges. Normally, for wide bends, the upper setback face of the contact arms is employed for gauging and work holding. As the width of the bend decreases, it is apparent that the gauge must be moved toward the die. For very small bends, then, the front of the arm may rest on the upper surface of the die, in which case the front contact surface of the arm is employed as the gauging surface. In order to avoid the upper die from hitting the arm as it is lowered, it is therefore necessary to step back the upper portion of the arm, so that the upper die can clear the arm.

The stop 114 is preferably also dimensioned so that the forward top edge of the block 110 will strike this top when the arm has been angled upward at an angle of about 45°, to thereby limit the possible motion of the arm.

The embodiment of the invention illustrated in FIG. 13 is essentially the same as that of FIGS. 11 and 12, with the exception that the clamp 130 and housing 140 are shaped to form a more unitary structure, with even top surfaces.

While the invention has been disclosed and described with reference to a limited number of embodiments, it will be apparent that variations and modifications may be made therein, and it is therefore intended in the following claims to cover each such variation and modification as falls within the true spirit and scope of the invention.

What is claimed is:

1. In a forming machine for forming an element of conductive material and having gauge means spaced from a forming area: the improvement wherein said gauge means comprises a pair of electrical contacts, said contacts being positioned to be engaged by said element when said element is in a forming position, and circuit means connected to said contacts for indicating the positioning of said element when it engages said contacts.

2. The forming machine of claim 1, wherein said gauge means further comprises an electromagnet, said contacts forming at least a portion of the core of said electromagnet and being electrically insulated from one another.

3. The machine of claim 2 wherein said gauge means has a magnetic back plate, said electrical contacts forming the front portions of said core and being insulated from the back plate.

4. The machine of claim 2 wherein said electromagnet has an axis extending parallel to the width direction of said machine, said electrical contacts forming opposite end portions of the core of said electromagnet, and said electric contacts further comprising conductive arms pivotally mounted to the ends of said core portions, and stop means for inhibiting pivoting of said arms below a horizontal position while permitting upward movement thereof.

5. The machine of claim 4 wherein said arms extend toward the dies of said machine, and have first end planar contact surfaces and second contact surfaces set back from the ends thereof, said contact surfaces extending vertically, and further comprising insulation surrounding the ends of said arms except at said contact surfaces.

6. The machine of claim 2 wherein said gauge means comprises clamp means for adjustably affixing said gauge means to a frame element of said machine.

7. The machine of claim 3 further comprising a bracket removably affixed to said gauge, said electric contacts further comprising arms pivoted to said bracket and contacting the core faces of said cores.

8. The machine of claim 3 wherein said electrical contacts comprise pivoted arms on the cores of said electromagnet.

9. The machine of claim 2 wherein said circuit means comprises relay means connected to be energized when said electric contacts are bridged by said element, said relay means having contact means connected to energize said electromagnet for holding said element to said electric contacts.

10. The machine of claim 2 further comprising electric probe means adjustably mounted to said machine, and positionable to engage the side edge of said element, said circuit means further being connected to said probe means for indicating electrical connection between said probe means and at least one of said electrical contacts.

11. The machine of claim 1, wherein said machine comprises a press brake.

* * * * *